US012369636B2

(12) United States Patent
Shi et al.

(10) Patent No.: US 12,369,636 B2
(45) Date of Patent: Jul. 29, 2025

(54) ELECTRONIC ATOMIZATION APPARATUS, AND ATOMIZER AND HEATING BODY OF ELECTRONIC ATOMIZATION APPARATUS

(71) Applicant: SHENZHEN SMOORE TECHNOLOGY LIMITED, Guangdong (CN)

(72) Inventors: Zhiqiang Shi, Shenzhen (CN); Guangwu Tang, Shenzhen (CN); Xianjun Fu, Shenzhen (CN)

(73) Assignee: SHENZHEN SMOORE TECHNOLOGY LIMITED, Shenzhen (CN)

( * ) Notice: Subject to any disclaimer, the term of this patent is extended or adjusted under 35 U.S.C. 154(b) by 418 days.

(21) Appl. No.: 17/863,082

(22) Filed: Jul. 12, 2022

(65) Prior Publication Data

US 2022/0338543 A1 Oct. 27, 2022

Related U.S. Application Data

(63) Continuation of application No. PCT/CN2020/072794, filed on Jan. 17, 2020.

(51) Int. Cl.

| | |
|---|---|
| ***A24F 40/46*** | (2020.01) |
| ***A24F 40/10*** | (2020.01) |
| ***A24F 40/44*** | (2020.01) |

(52) U.S. Cl.

CPC ..... *A24F 40/46* (2020.01); *A24F 40/10* (2020.01); *A24F 40/44* (2020.01)

(58) Field of Classification Search

None

See application file for complete search history.

(56) References Cited

U.S. PATENT DOCUMENTS

| | | | |
|---|---|---|---|
| 2014/0130816 | A1 | 5/2014 | Liu |
| 2017/0224018 | A1 | 8/2017 | Li et al. |
| 2018/0242643 | A1 | 8/2018 | Silvesstrini et al. |
| 2019/0098935 | A1 | 4/2019 | Phan et al. |
| 2021/0000179 | A1 | 1/2021 | Li et al. |

FOREIGN PATENT DOCUMENTS

| | | | |
|---|---|---|---|
| CN | 102869630 | A | 1/2013 |
| CN | 104053372 | A | 9/2014 |
| CN | 106542733 | A | 3/2017 |
| CN | 108308715 | A | 7/2018 |
| CN | 109195653 | A | 1/2019 |
| CN | 109259331 | A | 1/2019 |
| CN | 109561736 | A | 4/2019 |

(Continued)

OTHER PUBLICATIONS

Chinese Patent Office, Office Action in Chinese Patent Application No. 202010053850.3 (Jun. 1, 2023).

(Continued)

*Primary Examiner* — Phu H Nguyen

(74) *Attorney, Agent, or Firm* — Leydig, Voit & Mayer, Ltd.

(57) ABSTRACT

A heating body for heating a vaporized aerosol generation substrate includes: a substrate layer having a first surface and a second surface opposite the first surface; a heating layer formed on the first surface and/or the second surface; and a plurality of through holes having a capillary force. Each through hole of the plurality of through holes is elongated and extends through the first surface to the second surface.

30 Claims, 7 Drawing Sheets

(56) References Cited

FOREIGN PATENT DOCUMENTS

| | | | |
|---|---|---|---|
| CN | 109674092 | A | 4/2019 |
| CN | 109984387 | A | 7/2019 |
| CN | 209235000 | U | 8/2019 |
| CN | 110250590 | A | 9/2019 |
| CN | 209376696 | U | 9/2019 |
| CN | 209498589 | U | 10/2019 |
| CN | 111109665 | A | 5/2020 |
| DE | 102014106590 | A1 | 11/2015 |
| WO | 2019072915 | A1 | 4/2019 |
| WO | 2019157651 | A1 | 8/2019 |

OTHER PUBLICATIONS

Chinese Patent Office, Rejection Decision in Chinese Patent Application No. 202011269827.4 (Jun. 1, 2023).
Patent Cooperation Treaty, International Search Report, International Application No. PCT/CN2020/072794 (Oct. 14, 2020).
Patent Cooperation Treaty, Written Opinion of the International Searching Authority, International Application No. PCT/CN2020/072794 (Oct. 14, 2020).
Patent Cooperation Treaty, International Search Report, International Application No. PCT/CN2020/128515 (Feb. 19, 2021).
Patent Cooperation Treaty, Written Opinion of the International Searching Authority, International Application No. PCT/CN2020/128515 (Feb. 19, 2021).
Chinese Patent Office, Second Office Action in Chinese Patent Application No. 202011269827.4 (Nov. 21, 2022).
Chinese Patent Office, Office Action in Chinese Patent Application No. 202010053850.3 (Oct. 28, 2023).
Chinese Patent Office, Rejection Decision in Chinese Patent Application No. 202010053850.3 (Dec. 19, 2023).
European Patent Office, Search Report in European Patent Application No. 20914115.9 (Sep. 25, 2023).
Chinese Patent Office, First Office Action in Chinese Patent Application No. 202010053850.3 (Aug. 18, 2022).
Chinese Patent Office, First Office Action in Chinese Patent Application No. 202011269827.4 (Jul. 20, 2022).

ELECTRONIC ATOMIZATION APPARATUS, AND ATOMIZER AND HEATING BODY OF ELECTRONIC ATOMIZATION APPARATUS

CROSS-REFERENCE TO PRIOR APPLICATION

This application is a continuation of International Patent Application No. PCT/CN2020/072794, filed on Jan. 17, 2020. The entire disclosure is hereby incorporated by reference herein.

FIELD

The present invention relates to a vaporization device, and in particular, to an electronic vaporization device and a vaporizer and a heating body thereof.

BACKGROUND

An electronic vaporization device is generally used to simulate smoking articles or inhalers of inhaled medicaments for the treatment of respiratory diseases. The electronic vaporization device includes a vaporizer and a power supply. The vaporizer is provided with a heating body for vaporizing an aerosol generation substrate.

A wick is an existing heating body, and the wick causes a to-be-vaporized liquid aerosol generation substrate to reach a heating wire through capillary action. The wicks are mostly made of fiberglass, and individual fiberglass fibers easily break. Therefore, the user may inhale fiber fragments that get loose or fall off.

A porous ceramic heating body increasingly more popular in the market due to relatively high temperature stability and relative safety. The heating power of the heating body is set to match the parameters of the ceramic body, such as a thermal conductivity, a porosity, a permeability, and the like. However, in batch production of porous ceramics, the range of the porosity fluctuates greatly, and the heating power is difficult to match accurately, resulting in inconsistent vaporization effects of electronic vaporization devices delivered in the same batch.

In addition, because the porous ceramic has poor liquid-locking ability, oil leakage easily occurs. A surface of the porous ceramic is relatively rough, and a thickness of the heating film is difficult to be uniform, resulting in a local high temperature and dry burning.

SUMMARY

In an embodiment, the present invention provides a heating body configured to heat a vaporized aerosol generation substrate, the heating body comprising: a substrate layer comprising a first surface and a second surface opposite the first surface; a heating layer formed on the first surface and/or the second surface; and a plurality of through holes having a capillary force, wherein each through hole of the plurality of through holes is elongated and extends through the first surface to the second surface.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
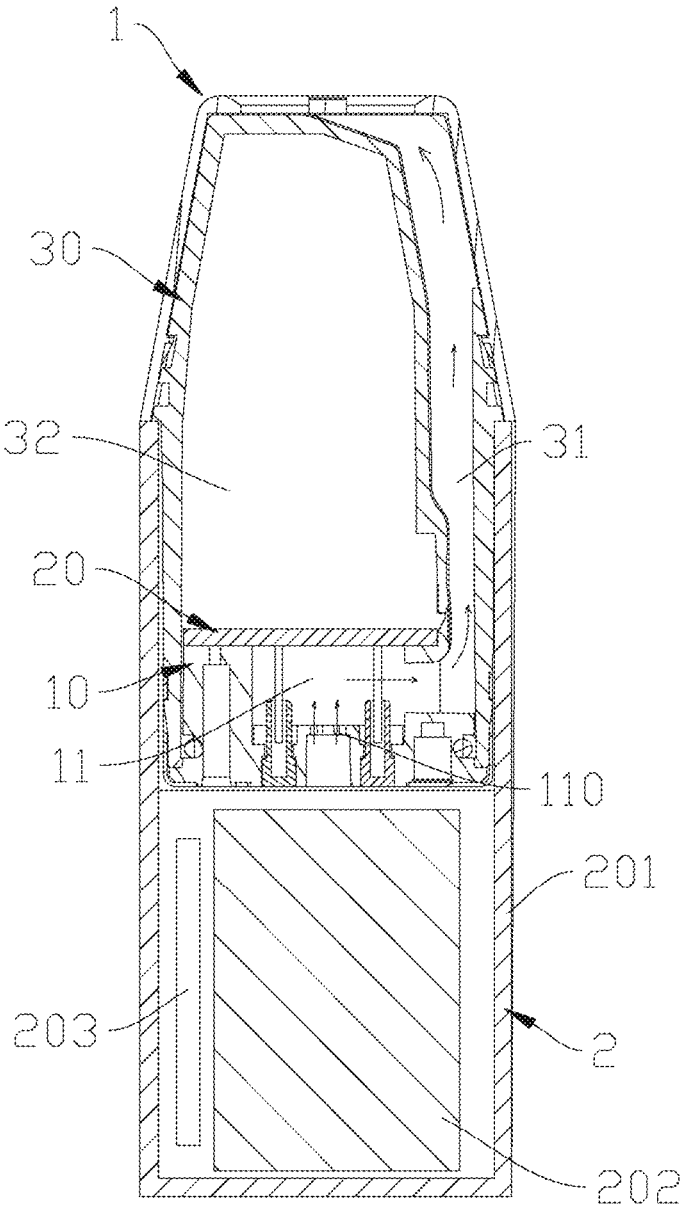
FIG. 1 is a schematic diagram of a longitudinal cross-sectional structure of a vaporizer in some embodiments of the present invention.

In an embodiment, the present invention provides an improved electronic vaporization device and a vaporizer and a heating body thereof.

In an embodiment, the present invention provides a heating body configured to heat a vaporized aerosol generation substrate. The heating body includes:

- a substrate layer, including a first surface and a second surface opposite to the first surface; and
- a heating layer, formed on the first surface and/or the second surface.
- the heating body further includes a plurality of through holes having a capillary force, where the through holes are elongated and extend through the first surface to the second surface.

In some embodiments, each of the through holes includes a linear longitudinal axis, and the plurality of through holes further extend through the heating layer.

In some embodiments, the first surface includes a first flat surface, the second surface includes a second flat surface, the first flat surface and the second flat surface are parallel to each other, the plurality of through holes extend through the first flat surface to the second flat surface, and the longitudinal axis of each through hole is perpendicular to or intersects with the first flat surface and the second flat surface.

In some embodiments, the first surface includes a first cylindrical surface, the second surface includes a second cylindrical surface, the second cylindrical surface is coaxial with the first cylindrical surface, and the plurality of through holes extend through the first cylindrical surface to the second cylindrical surface along a normal direction of the first cylindrical surface and the second cylindrical surface.

In some embodiments, the substrate layer includes a glass layer or a dense ceramic layer.

In some embodiments, a thickness of the heating body ranges from 0.1 mm to 10 mm.

In some embodiments, a porosity of the heating body ranges from 0.1 to 0.9.

In some embodiments, pore sizes of the plurality of through holes range from 1 μm to 200 μm.

In some embodiments, a thickness of the heating layer ranges from 1 μm to 200 μm.

In some embodiments, a resistance of the heating layer ranges from 0.1 ohms to 10 ohms.

In some embodiments, a material of the heating layer is one or any combination of nickel, chromium, silver, palladium, ruthenium, or platinum.

In some embodiments, a thermal conductivity of the substrate layer ranges from 0.1 W/mK to 5 W/mK.

In some embodiments, the through holes and/or the substrate layer are/is in a regular geometrical shape.

In some embodiments, the substrate layer includes a dense substrate. The plurality of through holes are arranged on the substrate in a circular array or a rectangular array, and pore sizes of the through holes among the plurality of through holes in different regions are the same or different.

In some embodiments, the heating layer is formed on the first surface. The heating body further includes a protective layer formed on a surface of the heating layer, and the plurality of through holes further extend through the protective layer.

In some embodiments, the heating body further includes an isolation layer formed on the second surface, and the plurality of through holes further extend through the isolation layer.

In some embodiments, the heating layer is formed on the second surface, and the heating body further includes an isolation layer formed on a surface of the heating layer.

In some embodiments, the heating layer includes a first heating layer and a second heating layer. The first heating layer and the second heating layer are respectively formed on the first surface and the second surface. The plurality of through holes further extend through the first heating layer and the second heating layer.

In some embodiments, the heating body further includes a protective layer and an isolation layer. The protective layer and the isolation layer are respectively formed on the first heating layer and the second heating layer. The plurality of through holes further extend through the protective layer and the isolation layer.

In some embodiments, a thermal conductivity of the isolation layer ranges from 0.01 W/mK to 2 W/mK, and a thickness of the isolation layer ranges from 0.1 μm to 100 μm.

In some embodiments, the isolation layer includes a porous material made of nano-alumina, nano-zirconia, or nano-cerium oxide.

In some embodiments, a temperature field of the heating layer exhibits a gradient change in a direction from a middle to a periphery.

A vaporizer is further provided, including:

an accommodating cavity;

an aerosol generation substrate, accommodated in the accommodating cavity; and the heating body in any of the above, where ends of the plurality of through holes close to the second surface are fluidly connected to the aerosol generation substrate.

In some embodiments, a surface tension of the aerosol generation substrate ranges from 10 mN/m to 75 mN/m.

An electronic vaporization device is further provided, including:

an accommodating cavity;

an aerosol generation substrate, accommodated in the accommodating cavity;

the heating body in any of the above; and a power supply device, electrically connected to the heating body, where ends of the plurality of through holes close to the second surface are fluidly connected to the aerosol substrate.

In some embodiments, a viscosity of the aerosol generation substrate ranges from 40 cP to 1000 cP, a working temperature on a side of the heating body away from the aerosol generation substrate ranges from 100° C. to 350° C., and a working temperature on a side of the heating body close to the aerosol generation substrate ranges from 22° C. to 100° C.

In some embodiments, a viscosity of the aerosol generation substrate ranges from 1000 cP to 10000 cP, a working temperature on a side of the heating body away from the aerosol generation substrate ranges from 150° C. to 250° C., and a working temperature on a side of the heating body close to the aerosol generation substrate ranges from 80° C. to 150° C.

In some embodiments, a viscosity of the aerosol generation substrate ranges from 0.1 cP to 40 cP, a working temperature on a side of the heating body away from the aerosol generation substrate ranges from 70° C. to 150° C., and a working temperature on a side of the heating body close to the aerosol generation substrate ranges from 22° C. to 40° C.

In some embodiments, a surface tension of the aerosol generation substrate ranges from 10 mN/m to 75 mN/m.

BENEFICIAL EFFECTS

Beneficial effects of the present invention are as follows. The substrate layer and the plurality of through holes having the capillary force are used, so that a porosity of the heating body can be accurately controlled, thereby improving consistency of products.

Optimal Implementations of the Present Invention

In order to describe the present invention more clearly, the present invention is further described below with reference to the accompanying drawings.

It should be understood that terms such as "front", "rear", "left", "right", "upper", "lower", "first" and "second" are only for the convenience of describing the technical solutions of the present invention rather than indicating that the referred devices or elements need to have special differences, and therefore should not be construed as a limitation to the present invention. An element, when considered to be "connected" to another element, may be directly connected to the another element or there may be a central element at the same time. Unless otherwise defined, all technical and scientific terms used herein have the same meaning as commonly understood by a person of ordinary skill in the art to which the present invention belongs. In this specification, terms used in the specification of the present invention are merely intended to describe objectives of the specific embodiments, but are not intended to limit the present invention.

FIG. 1 shows an electronic vaporization device in some embodiments of the present invention. The electronic vaporization device has excellent and consistent vaporization amount parameters, and may include a vaporizer 1 and a power supply device 2 detachably connected to the vaporizer 1. The vaporizer 1 is configured to accommodate an aerosol generation substrate such as e-liquid or a medicament, and heat and vaporize the aerosol generation substrate. The power supply device 2 is configured to supply power to the vaporizer 1 and control the electronic vaporization device. It may be understood that, the power supply device 2 is not limited to be detachably connected to the vaporizer 1, and the power supply device and the vaporizer may also be connected as a whole.

In some embodiments, the vaporizer 1 may include a base 10, a heating body 20 mounted to the base 10, and a housing 30 connected to the base 10. A vaporization cavity 11 for mist and air to be mixed may be formed between the base 10 and a lower side surface of the heating body 20, and an air inlet 110 for communicating the vaporization cavity 11 with outside may further be formed on the base 10. The heating body 20 may be configured to suck and heat and vaporize an aerosol generation substrate in an accommodating cavity 32 after being energized. An airflow channel 31 for leading out the mixture of mist and air may be formed in the housing 30, and is in communication with an air outlet side of the vaporization cavity 11. The accommodating cavity 32 for storing the aerosol generation substrate such as e-liquid may further be formed in the housing 30, and is fluidly connected to an upper side surface of the heating body 20. It may be understood that the heating body 20 is not limited to the horizontal arrangement shown in the figure, but may also be arranged vertically.

In some embodiments, the power supply device 2 may include a housing 201 detachably connected to the vaporizer 1, and a rechargeable or non-rechargeable battery 202 and a control circuit 203 arranged in the housing 201. The control circuit 203 may control the battery 202 to provide a corresponding preset power according to a set vaporization amount.

Figure 2:
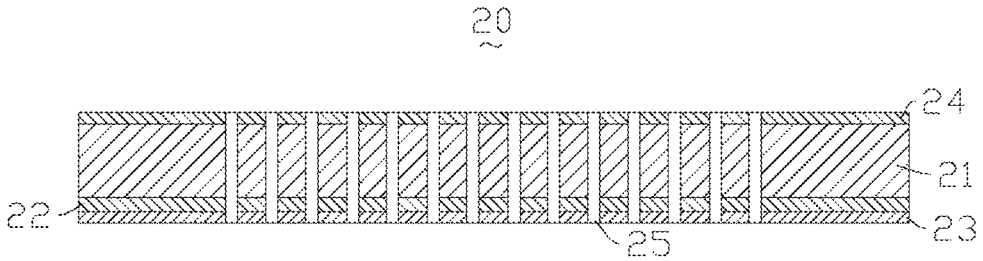
FIG. 2 is a schematic diagram of a cross-sectional structure of a heating body of the vaporizer shown in FIG. 1.

FIG. 2 shows a heating body 20 in some embodiments of the present invention. The heating body 20 has an excellent liquid-locking function and is configured to have a precisely controllable range of porosities. As shown in the figure, in some embodiments, the heating body 20 may include a substrate layer 21 having a first surface (a bottom surface shown in the figure) and a second surface (a top surface shown in the figure) opposite to the first surface, a heating layer 22 formed on the first surface of the substrate layer 21, a protective layer 23 formed on a surface of the heating layer 22, an isolation layer 24 formed on the second surface of the substrate layer 21, and a plurality of elongated through holes 25 having a capillary force and extending through an outer surface of the isolation layer 24 to an outer surface of the protective layer 23.

In some embodiments, the substrate layer 21 may be flat, and the first surface and the second surface of the substrate layer may be both flat surfaces. In some embodiments, the through holes 25 may be cylindrical, each of which has a linear longitudinal axis. The longitudinal axis is preferably perpendicular to the first surface and the second surface. It may be understood that the through holes 25 may also be arranged in other regular geometric shapes. Since the through holes 25 are arranged in a regular geometric shape, a volume of the through holes 25 in the heating body 20 may be calculated, and the porosity of the whole heating body 20 may also be calculated, so that the consistency of the porosities of the heating bodies 20 of similar products can be well guaranteed.

In some embodiments, the substrate layer 21 may be a glass layer, a dense ceramic layer, or a layer made of other suitable materials, which preferably has a dense substrate, a smooth surface, and a regular shape (for example, regular geometric shapes such as a rectangular plate shape, a circular plate shape, a cylindric shape, and the like) for better control and calculation of parameters such as the porosity. In some embodiments, when the substrate layer 21 is a glass layer, which may be a glass ceramic layer, a common glass layer, or a quartz glass layer, a thermal conductivity of the substrate layer may range from 0.1 W/mK to 5 W/mK, and preferably 0.3 W/mK to 5 W/mK. In some embodiments, a thickness of the heating body 20 is preferably between 0.1 mm and 10 mm, and the porosity is between 0.2 and 0.8. The substrate layer 21 samples a dense substrate, which indicates that a solid part of the substrate layer 21 itself does not guide liquid. The porosity of the whole structure is realized by processing the through holes 25, so as to ensure the excellent consistency of the porosities of the same heating body 20, thereby better overcoming the defect that the porosity of porous bodies such as sintered ceramics is difficult to accurately control.

In some embodiments, a thickness of the heating layer 22 may range from 1 μm to 200 μm, and a resistance of the heating layer may range from 0.1 ohms to 10 ohms, preferably 0.4 ohms to 3 ohms. The temperature field of the heating layer 22 may be uniform, or may exhibit a section-by-section change or a gradient change. In some embodiments, a positive electrode and a negative electrode are respectively arranged on two sides of the heating layer 22. The positive electrode and the negative electrode are respectively electrically connected to the power supply device 2. A material of the heating layer 22 may be metal such as nickel, chromium, silver, palladium, ruthenium, platinum, or an alloy formed by two or more metals.

In some embodiments, axes of the through holes 25 having a capillary force may be straight lines and are arranged perpendicular to the substrate layer 21. In some embodiments, the through holes 25 having the capillary force may be cylindrical, and pore sizes of the through holes may preferably range from 1 μm to 200 μm. During use of the heating body 20, ends of the through holes 25 having the capillary force are directly in contact with the aerosol generation substrate (e-liquid) accommodated in the accommodating cavity, so as to absorb the aerosol generation substrate to the heating body 20 by using the capillary force. When the substrate layer 21 is glass, the through holes 25 having the capillary force may be formed by laser-induced deep etching, or may be formed by using a combination process such as photosensitive glass exposure, tempering, etching, and the like.

Figure 3:
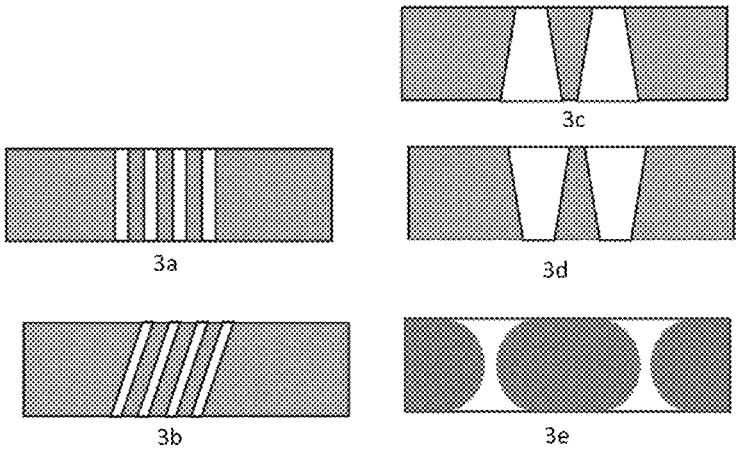
FIG. 3 is a schematic diagram of shapes of through holes in different embodiments.

It may be understood that the through holes 25 having the capillary force may also be in various shapes. As shown in FIG. 3, the through holes 25 having the capillary force is not limited to the vertical cylindrical shape shown in FIG. 3*a*, but may be an inclined cylindrical shape shown in FIG. 3*b*, a shape of a frustum of a cone shown in FIG. 3*c*, a shape of a frustum of a cone shown in FIG. 3*d*, and a dumbbell shape big at two ends and small in the middle shown in FIG. 3*e*. Preferably, the shapes of the through holes 25 are preferred to facilitate the manufacturing and the calculation of the volumes of the through holes.

Figure 4:
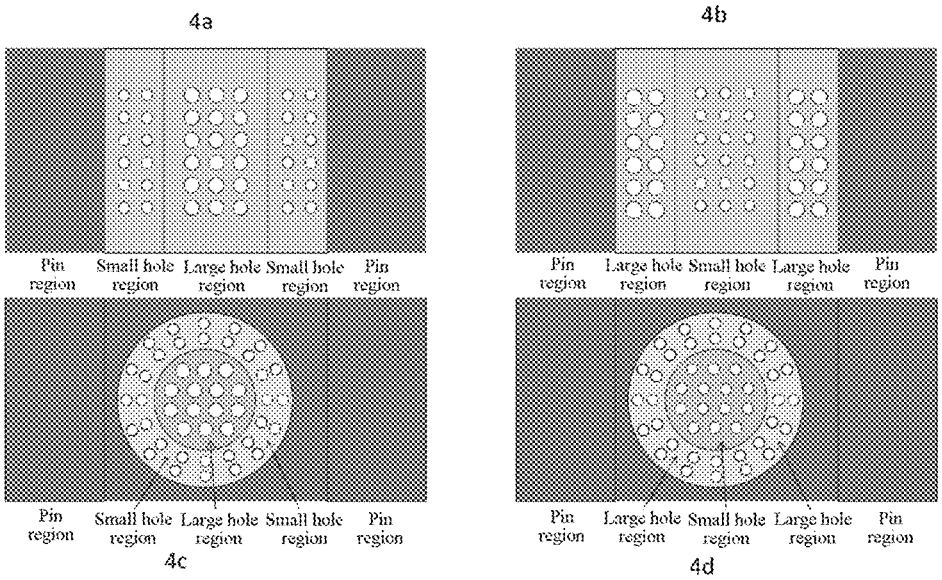
FIG. 4 is a schematic diagram showing distribution of through holes in different embodiments.

As shown in FIG. 4, the through holes 25 having the capillary force are not limited to the same size, and different sizes of the through holes may also be used for different matching. Different sizes and arrangement densities of the through holes 25 can change the surface heat flux density and also affect an e-liquid guiding rate. The surface temperature field can be designed by adjusting the distribution of the through holes 25 on the surface, to improve the consistency and dry burning resistance of the heating body 20.

As shown in FIG. 4*a* and FIG. 4*b*, the through holes 25 having the capillary force are arranged in a rectangular array. In the solution shown in FIG. 4*a*, pore sizes of the through holes 25 having the capillary force in the middle region are larger than pore sizes of the through holes 25 having the capillary force in two side regions. In the solution shown in FIG. 4*b*, pore sizes of the through holes 25 having the capillary force in the middle region are larger than pore sizes of the through holes 25 having the capillary force in two side regions. As shown in FIG. 4*c* and FIG. 4*d*, the through holes 25 having the capillary force are arranged in a circular array. In the solution shown in FIG. 4*c*, pore sizes of the through holes 25 having the capillary force in the middle region are larger than pore sizes of the through holes 25 having the capillary force in a peripheral region. In the solution shown in FIG. 4*d*, pore sizes of the through holes 25 having the capillary force in the middle region are smaller than pore sizes of the through holes 25 having the capillary force in the peripheral region.

Figure 5:
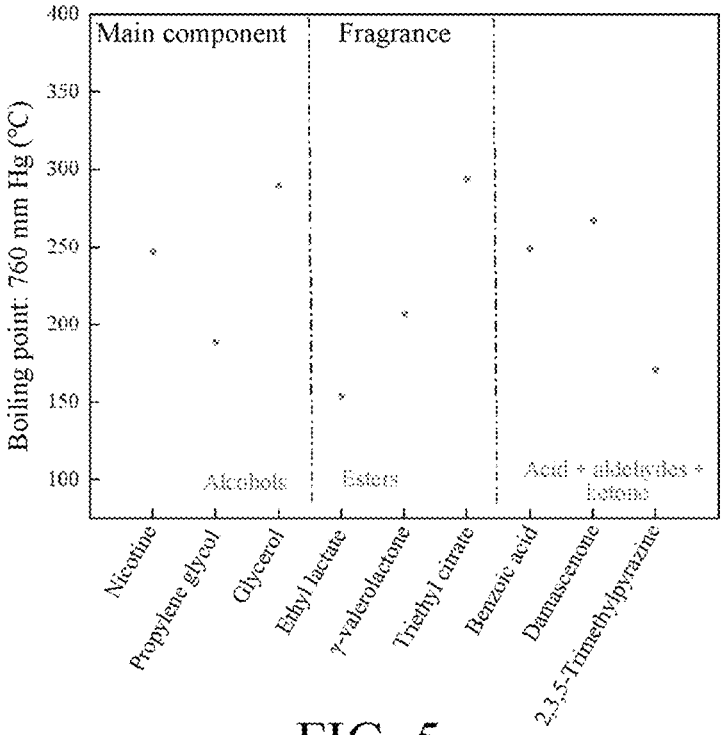
FIG. 5 is a schematic diagram showing distribution of boiling points of e-liquid components.

In some embodiments, the temperature field of the heating layer 22 exhibits a gradient change from a central position of the heating layer 22 to a peripheral position. As such, e-liquid components having different boiling points may be vaporized in different regions, so that the taste is better. Specifically, as shown in FIG. 5, the aerosol generation substrate is e-liquid by way of example. The e-liquid includes e-liquid components having different boiling points, including nicotine with a boiling point of about 250 degrees, propylene glycol with a boiling point of about 180 degrees, glycerol with a boiling point of about 290 degrees, ethyl lactate with a boiling point of about 150 degrees, γ-valerolactone with a boiling point of about 200 degrees, triethyl citrate with a boiling point of about 290 degrees, benzoic acid with a boiling point of about 250 degrees, damascenone with a boiling point of about 270 degrees, and 2,3,5-Trimethylpyrazine with a boiling point of about 170 degrees.

Figure 6:
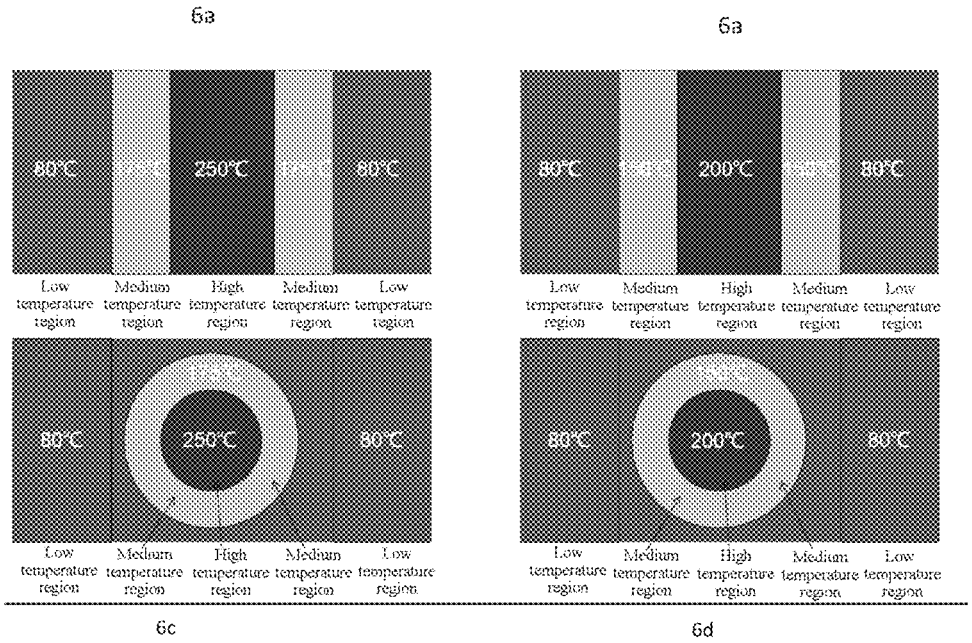
FIG. 6 is a schematic diagram showing distribution of temperature fields of the heating body.

Therefore, temperature distribution fields having different regions shown in FIG. 6 are arranged. As shown in FIG. 6*a* and FIG. 6*b*, the temperature field exhibits a gradient decrease from the middle to both sides. As shown in FIG. 6*c* and FIG. 6*d*, the temperature field exhibits a gradient decrease from the middle to the periphery. It may be understood that the temperature field is not limited to exhibiting the gradient decrease from the middle to the periphery, and in some cases, the temperature field may also exhibit a gradient increase.

The isolation layer 24 is configured to isolate the substrate layer 21 from the aerosol generation substrate, and has the functions of heat insulation and anti-corrosion. In some embodiments, a thermal conductivity of the isolation layer 24 may range from 0.01 W/mK to 2 W/mK, and a thickness of the isolation layer may range from 0.1 μm to 100 μm. In some embodiments, the isolation layer 24 may be made of a porous material such as nano-alumina, nano-zirconia, or nano-cerium oxide. In some embodiments, the protective layer 23 is configured to prevent or reduce the contact between the e-liquid and the heating layer 22, so as to prevent the vaporized gas from bringing out harmful substances in the heating layer 22.

In some embodiments, the existence of the through holes 25 having the capillary force may further improve the liquid-locking ability of the heating body 20. In some embodiments, the liquid-locking ability of the through holes 25 having the capillary force is proportional to the surface tension of the aerosol generation substrate. A larger surface tension leads to stronger liquid-locking ability. In order to better lock e-liquid and prevent e-liquid leakage, the surface tension of suitable aerosol generation substrates such as e-liquid may range from 10 mN/m to 75 mN/m, preferably from 38 mN/m to 65 mN/m.

In some embodiments, a power supply is controlled to provide a corresponding preset power according to the set vaporization amount. The preset power is associated with the volume of all of the through holes 25 having the capillary force and the viscosity of the aerosol generation substrate. Since the structure, the shape, and the size of the through holes 25 having the capillary force in the substrate layer 25 are relatively consistent, the capillary liquid guide rate is very stable during the vaporization, and the vaporization amount of each puff may be precisely controlled by controlling the power. In addition, during the vaporization, the through holes 25 having the capillary force provide sufficient e-liquid guide and e-liquid supply at a stable rate. The e-liquid supply amount has a strong correspondence with the time, and the precise control of the dosage can also be achieved by time control.

Figure 7:
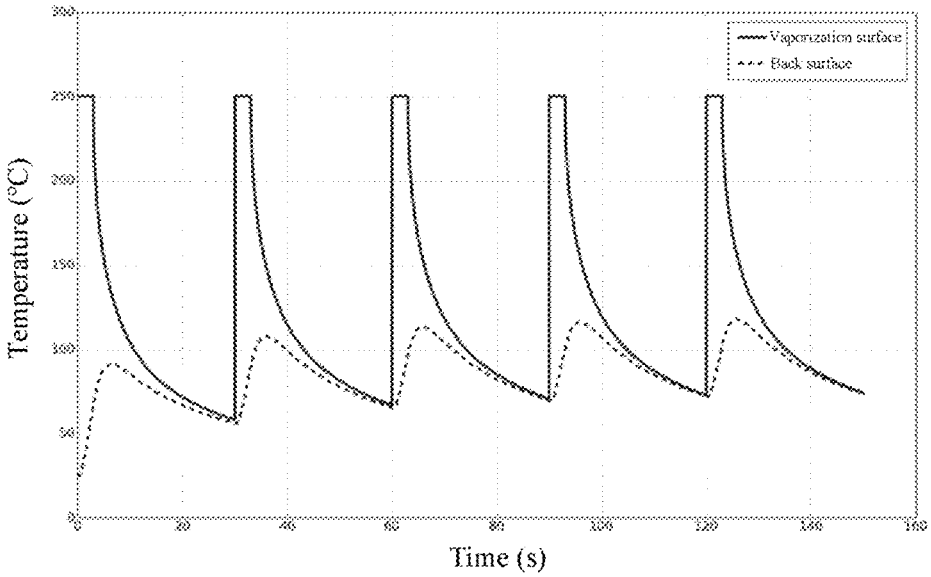
FIG. 7 is a graph showing temperature rise of the heating body with time variations in some embodiments.
Figure 8:
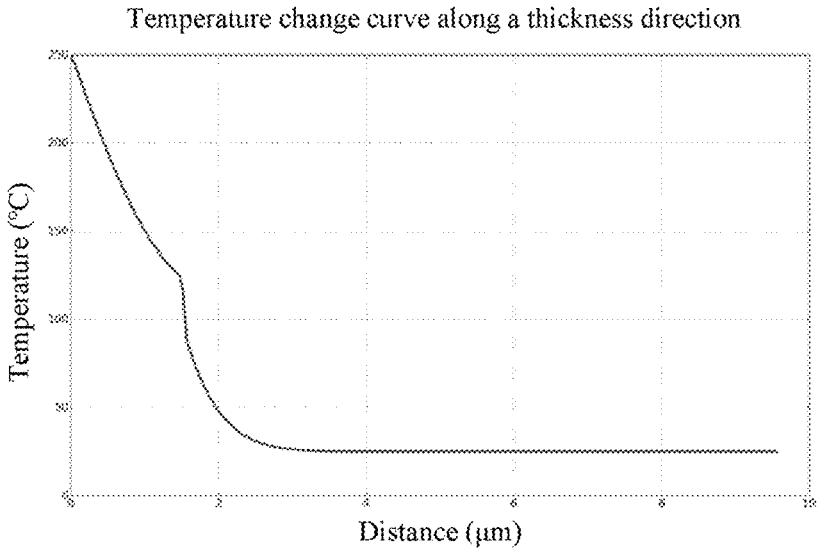
FIG. 8 is a graph showing temperature variations of the heating body with thickness variations in some embodiments.

In some embodiments, an electronic vaporization device is provided. A viscosity of an aerosol generation substrate of the electronic vaporization device ranges from 40 cP to 1000 cP. A heating body 20 is configured, so that a working temperature on a side of the heating body 20 away from the aerosol generation substrate may range from 100° C. to 350° C., and a working temperature on a side of the heating body 20 close to the aerosol generation substrate may range from 22° C. to 100° C. Specifically, pore sizes of the through holes 25 having the capillary force arranged in a matrix may be set to 10 μm, a spacing between the holes is set to 20 μm, a thickness of a glass substrate layer 21 is set to 1500 μm, a length of the glass substrate layer is set to 9.9 mm and 5.49 mm, and a thickness of the heating layer is set to 10 μm. A total thickness of the protective layer and the isolation layer is 50 μm. At this point, after testing, temperature rise curves of a vaporization surface (the bottom surface shown in FIG. 1) and a back surface (the top surface shown in FIG. 1) of the heating body 20 are shown in FIG. 7. At this time, the maximum temperature of the back surface after a first puff is about 90 degrees. The surface temperature of the heating body 20 is uniform, an internal temperature drop along the thickness direction is about 169 degrees, and a variation curve of temperatures of the heating body along the thickness direction is shown in FIG. 8.

Figure 9:
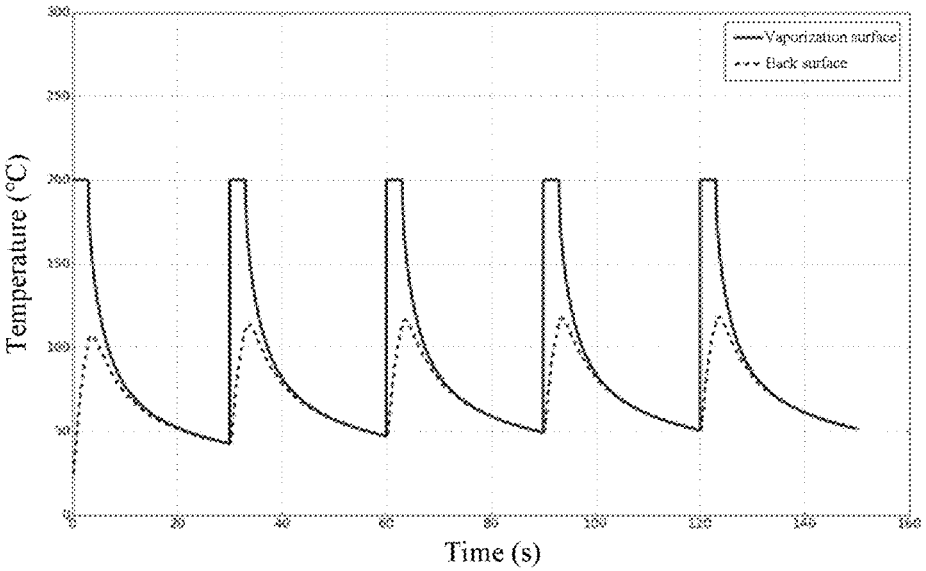
FIG. 9 is a graph showing temperature rise of the heating body with time variations in some other embodiments.
Figure 10:
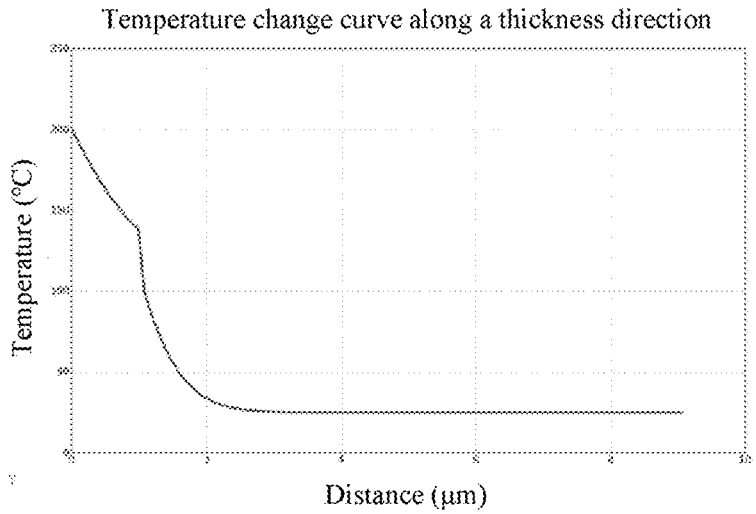
FIG. 10 is a graph showing temperature variations of the heating body with thickness variations in some other embodiments.

In some other embodiments, an electronic vaporization device is provided. A viscosity of an aerosol generation substrate of the electronic vaporization device ranges from 1000 cP to 10000 cP. A heating body 20 is configured, so that a working temperature on a side of the heating body 20 away from the aerosol generation substrate in an accommodating cavity 32 ranges from 150° C. to 250° C., and a working temperature on a side of the heating body 20 close to the aerosol generation substrate in the accommodating cavity 32 ranges from 80° C. to 150° C. Specifically, pore sizes of the through holes 25 having the capillary force arranged in a matrix may be set to 10 μm, a spacing between the holes is set to 20 μm, a thickness of a glass substrate layer 21 is set to 1000 μm, a length of the glass substrate layer is set to 8.03 mm and 4.03 mm, and a thickness of the heating layer is set to 10 μm. A total thickness of the protective layer and the isolation layer is 50 μm. Temperature rise curves of a vaporization surface (a surface on a side of the heating body away from the aerosol generation substrate) and a back surface (a surface on a side of the heating body close to the aerosol generation substrate) of the heating body 20 are shown in FIG. 9. At this point, the maximum temperature of the back surface after the first puff is about 107.7 degrees. The surface temperature of the heating body 20 is uniform, an internal temperature drop along the thickness direction is about 100 degrees, and a variation curve of temperatures of the heating body along the thickness direction is shown in FIG. 10.

In some other embodiments, an electronic vaporization device is provided. A viscosity of an aerosol generation substrate of the electronic vaporization device ranges from 0.1 cP to 40 cP. A heating body 20 is configured, so that a working temperature on a side of the heating body 20 away from the aerosol generation substrate in an accommodating cavity 32 ranges from 70° C. to 150° C., and a working temperature on a side of the heating body 20 close to the aerosol generation substrate in the accommodating cavity 32 ranges from 22° C. to 40° C. For the specific configuration of the heating body 20, reference may be made to the above, and the details are not described herein again.

Figure 11:
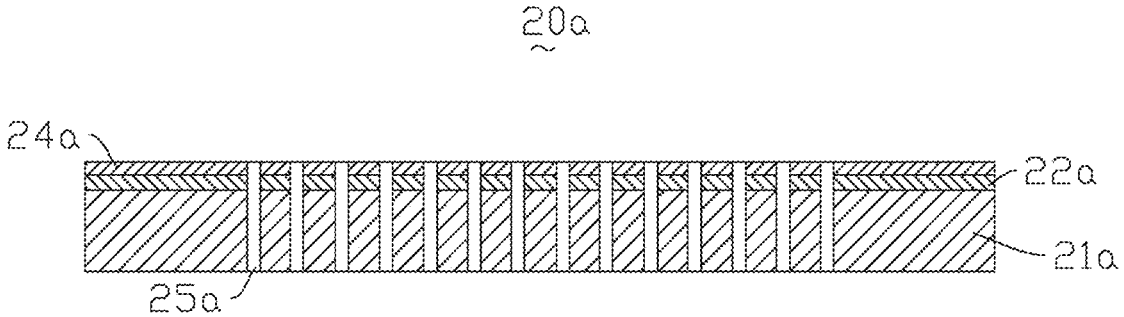
FIG. 11 is a schematic diagram of a longitudinal cross-sectional structure of a heating body in some other embodiments of the present invention.

FIG. 11 shows a heating body 20*a* in some embodiments of the present invention. The heating body 20*a* is similar to the above heating body 20, and may include a substrate layer 21*a* having a first surface and a second surface opposite to the first surface, a heating layer 22*a* formed on the second surface of the substrate layer 21*a*, an isolation layer 24*a* formed on a surface of the heating layer 22*a*, and a plurality of through holes 25 having a capillary force and extending through an outer surface of the isolation layer 24*a* to the first surface of the substrate layer 21*a*. Compared with the above heating body 20*a*, in the heating body 20*a*, the heating layer 22*a* is arranged on a side surface of the substrate layer 21*a* close to the aerosol generation substrate, so as to realize the protection and heat insulation of the heating layer 22*a* by the isolation layer 24*a*.

Figure 12:
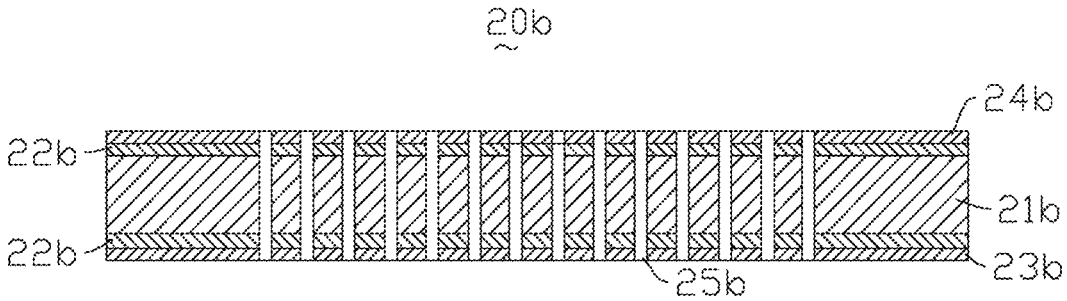
FIG. 12 is a schematic diagram of a longitudinal cross-sectional structure of a heating body in some other embodiments of the present invention.

FIG. 12 shows a heating body 20*b* in some embodiments of the present invention. The heating body 20*b* is similar to the above heating body 20, and may include a substrate layer 21*b* having a first surface and a second surface opposite to the first surface, two heating layers 22*b* respectively formed on the first surface and the second surface of the substrate layer 21*b*, a protective layer 23*b* and an isolation layer 24*b* respectively formed on surfaces of the two heating layers 22*b*, and a plurality of through holes 25*b* having a capillary force and extending through an outer surface of the isolation layer 24*b* to an outer surface of the protective layer 23*b*. The heating layer 21*b* distributed on the first surface is mainly configured to vaporize the aerosol generation substrate, and the heating layer 21*b* distributed on the second surface is mainly configured to preheat the aerosol generation substrate to reduce the viscosity of the aerosol generation substrate, thereby increasing the liquid guide rate. The two heating layers 21*b* may be simultaneously controlled electrically or independently. The resistances and shapes of the two heating layers may be the same or different, and may be set as required.

Figure 13:
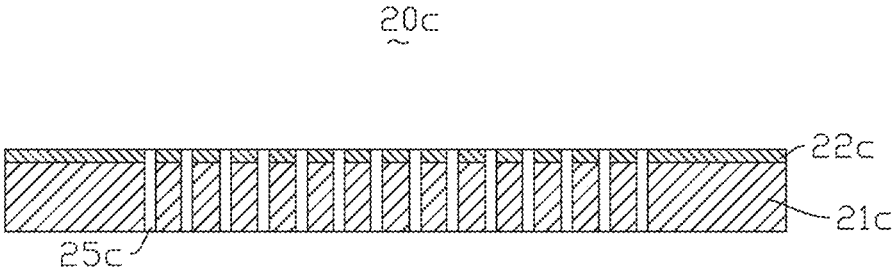
FIG. 13 is a schematic diagram of a longitudinal cross-sectional structure of a heating body in some other embodiments of the present invention.

FIG. 13 shows a heating body 20*c* in some embodiments of the present invention. The heating body 20*c* is similar to the above heating body 20, and may include a substrate layer 21*c* having a first surface and a second surface opposite to the first surface, a heating layers 22*c* formed on the first surface of the substrate layer 21*c*, and a plurality of through holes 25*c* having a capillary force and extending through the substrate layer 21*c* and the heating layers 22*c*. The heating body 20*c* may be suitable for use in some scenarios where heat insulation and protection are not severe.

Figure 14:
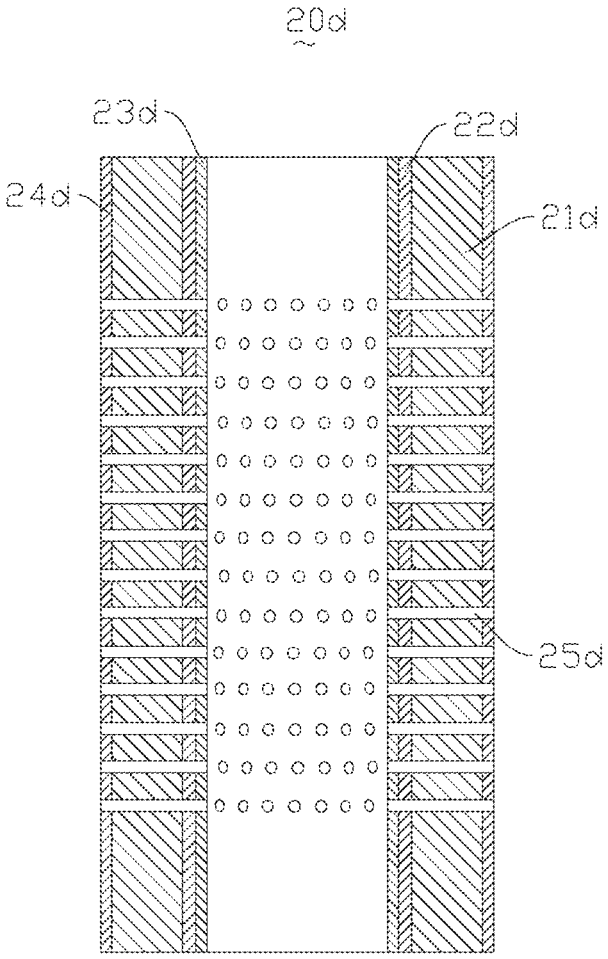
FIG. 14 is a schematic diagram of a longitudinal cross-sectional structure of a heating body in some other embodiments of the present invention.

FIG. 14 shows a heating body 20*d* in some embodiments of the present invention. The heating body 20*d* includes a cylindrical substrate layer 21*d*, a heating layer 22*d* formed on an inner surface of the substrate layer 21*d*, a protective layer 23*d* formed on a surface of the heating layer 22*d*, an isolation layer 24*d* formed on an outer surface of the substrate layer 21*d*, and a plurality of elongated through holes 25*d* having the capillary force and extending through an outer surface of the isolation layer 24*d* to an inner surface of the protective layer 23*d*. Preferably, the longitudinal axis of the through hole 25*d* coincides with a normal of the substrate layer 21*d*. In some embodiments, the inner surface and the outer surface of the substrate layer 21*d* may be both smooth cylindrical surfaces. The heating body 20*d* is suitable for being arranged vertically and surrounded by the accommodating cavity 32 of the vaporizer 1.

In some embodiments of the present invention, an electronic vaporization device having consistent vaporization parameters and a vaporizer and a heating body thereof are provided. The parameter "vaporization amount" is a vaporization amount per unit time in the case of a fixed power, a fixed air pressure, and sufficient supply of e-liquid.

The heating body in some embodiments of the present invention further has the advantages of excellent liquid locking, anti-leakage, and the like.

The heating body in some embodiments of the present invention further has the function of avoiding producing a burning smell due to the local high temperature. In addition, the surface of the substrate layer is easy to flatten, so that the thickness of the heating layer can be very precise.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A heating body configured to heat a vaporized aerosol generation substrate, the heating body comprising:

a substrate layer comprising a first surface and a second surface opposite the first surface;

a heating layer formed on the first surface; and a plurality of through holes having a capillary force, wherein each through hole of the plurality of through holes is elongated and extends through the first surface to the second surface, wherein the heating body further comprises a protective layer formed on a surface of the heating layer, and wherein the plurality of through holes extend through the protective layer.

2. The heating body of claim 1, wherein each through hole of the plurality of through holes comprises a linear longitudinal axis, and wherein the plurality of through holes extend through the heating layer.

3. The heating body of claim 2, wherein the first surface comprises a first flat surface and the second surface comprises a second flat surface, wherein the first flat surface and the second flat surface are parallel to each other, wherein the plurality of through holes extend through the first flat surface to the second flat surface, and wherein the longitudinal axis of each through hole is perpendicular to or intersects the first flat surface and the second flat surface.

4. The heating body of claim 2, wherein the first surface comprises a first cylindrical surface and the second surface comprises a second cylindrical surface, wherein the second cylindrical surface is coaxial with the first cylindrical surface, and wherein the plurality of through holes extend through the first cylindrical surface to the second cylindrical surface along a normal direction of the first cylindrical surface and the second cylindrical surface.

5. The heating body of claim 1, wherein the substrate layer comprises a glass layer or a dense ceramic layer.

6. The heating body of claim 1, wherein a thickness of the heating body ranges from 0.1 mm to 10 mm.

7. The heating body of claim 1, wherein a porosity of the heating body ranges from 0.1 to 0.9.

8. The heating body of claim 1, wherein pore sizes of the plurality of through holes range from 1 μm to 200 μm.

9. The heating body of claim 1, wherein a thickness of the heating layer ranges from 1 μm to 200 μm.

10. The heating body of claim 1, wherein a resistance of the heating layer ranges from 0.1 ohms to 10 ohms.

11. The heating body of claim 1, wherein a material of the heating layer comprises at least one of nickel, chromium, silver, palladium, ruthenium, or platinum.

12. The heating body of claim 1, wherein a thermal conductivity of the substrate layer ranges from 0.1 W/mK to 5 W/mK.

13. The heating body of claim 1, wherein each through hole of the plurality through holes and/or the substrate layer are/is in a regular geometrical shape.

14. The heating body of claim 1, wherein the substrate layer comprises a dense substrate, wherein the plurality of through holes are arranged on the substrate in a circular array or a rectangular array, and wherein pore sizes of the plurality of through holes are the same or different.

15. The heating body of claim 1, further comprising:

an isolation layer formed on the second surface, wherein the plurality of through holes extend through the isolation layer.

16. The heating body of claim 1, wherein the heating layer is formed on the second surface, and wherein the heating body further comprises an isolation layer formed on a surface of the heating layer.

17. The heating body of claim 1, further comprising:

a first heating layer; and a second heating layer, wherein the first heating layer and the second heating layer are respectively formed on the first surface and the second surface, and wherein the plurality of through holes extend through the first heating layer and the second heating layer.

18. The heating body of claim 17, further comprising:

a protective layer; and an isolation layer, wherein the protective layer and the isolation layer are respectively formed on the first heating layer and the second heating layer, and wherein the plurality of through holes extend through the protective layer and the isolation layer.

19. The heating body of claim 18, wherein a thermal conductivity of the isolation layer ranges from 0.01 W/mK to 2 W/mK, and a thickness of the isolation layer ranges from 0.1 μm to 100 μm.

20. The heating body of claim 18, wherein the isolation layer comprises a porous material comprising nano-alumina, nano-zirconia, or nano-cerium oxide.

21. The heating body of claim 1, wherein a temperature field of the heating layer exhibits a gradient change in a direction from a middle to a periphery.

22. A vaporizer, comprising:

an accommodating cavity;

an aerosol generation substrate accommodated in the accommodating cavity; and the heating body of claim 1, wherein ends of the plurality of through holes close to the second surface are fluidly connected to the aerosol generation substrate.

23. The vaporizer of claim 22, wherein a surface tension of the aerosol generation substrate ranges from 10 mN/m to 75 mN/m.

24. An electronic vaporization device, comprising:

an accommodating cavity;

an aerosol generation substrate accommodated in the accommodating cavity;

the heating body of claim 1; and a power supply device electrically connected to the heating body, wherein ends of the plurality of through holes close to the second surface are fluidly connected to the aerosol substrate.

25. The electronic vaporization device of claim 24, wherein a viscosity of the aerosol generation substrate ranges from 40 cP to 1000 cP, wherein a working temperature on a side of the heating body away from the aerosol generation substrate ranges from 100° C. to 350° C., and wherein a working temperature on a side of the heating body close to the aerosol generation substrate ranges from 22° C. to 100° C.

26. The electronic vaporization device of claim 24, wherein a viscosity of the aerosol generation substrate ranges from 1000 cP to 10000 cP, wherein a working temperature on a side of the heating body away from the aerosol generation substrate ranges from 150° C. to 250° C., and wherein a working temperature on a side of the heating body close to the aerosol generation substrate ranges from 80° C. to 150° C.

27. The electronic vaporization device of claim 24, wherein a viscosity of the aerosol generation substrate ranges from 0.1 cP to 40 cP, wherein a working temperature on a side of the heating body away from the aerosol generation substrate ranges from 70° C. to 150° C., and wherein a working temperature on a side of the heating body close to the aerosol generation substrate ranges from 22° C. to 40° C.

28. The electronic vaporization device of claim 24, wherein a surface tension of the aerosol generation substrate ranges from 10 mN/m to 75 mN/m.

29. The heating body of claim 1, wherein the heating body comprises at least two regions, and wherein pore sizes of the through holes of each region of the at least two regions are different.

30. The heating body of claim 29, wherein each region corresponds to a different surface temperature.

* * * * *